US006964383B2

(12) United States Patent
Heyse

(10) Patent No.: US 6,964,383 B2
(45) Date of Patent: Nov. 15, 2005

(54) FUEL INJECTOR

(75) Inventor: Joerg Heyse, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 371 days.

(21) Appl. No.: 10/148,946

(22) PCT Filed: Sep. 28, 2001

(86) PCT No.: PCT/DE01/03740

§ 371 (c)(1),
(2), (4) Date: Dec. 12, 2002

(87) PCT Pub. No.: WO02/29245

PCT Pub. Date: Apr. 11, 2002

(65) Prior Publication Data

US 2003/0116651 A1 Jun. 26, 2003

(30) Foreign Application Priority Data

Oct. 6, 2000 (DE) ..... 100 49 517

(51) Int. Cl.[7] ..... B05B 1/30; F02M 47/02; F02M 39/00

(52) U.S. Cl. ..... 239/585.1; 239/585.5; 239/533.2; 239/533.3; 239/533.12; 239/88

(58) Field of Search ..... 239/533.2, 533.3, 239/463, 468, 472, 475, 533.12, 585.1–585.5, 88–93, 601; 251/129.15, 129.21

(56) References Cited

U.S. PATENT DOCUMENTS 5,170,945 A * 12/1992 Daly et al. ..... 239/585.4
5,307,997 A * 5/1994 Wakeman ..... 239/491
5,570,841 A * 11/1996 Pace et al. ..... 239/585.1
5,649,354 A * 7/1997 Fujii et al. ..... 29/607
6,289,677 B1 * 9/2001 Prociw et al. ..... 60/748

* cited by examiner

*Primary Examiner*—Davis Hwu
(74) *Attorney, Agent, or Firm*—Kenyon & Kenyon

(57) ABSTRACT

A fuel injector, in particular for direct injection of fuel into the combustion chamber of an internal combustion engine, is equipped with a valve-closure member which together with a valve-seat surface that is formed on a valve-seat body constitutes a sealing seat, with an ejection orifice and with a swirl module. The swirl module incorporates a plurality of tubular hollow bodies which are disposed parallel to one another in a cluster and which impart turbulence to the fuel flowing towards the ejection orifice through the fuel ducts formed in the hollow bodies.

12 Claims, 2 Drawing Sheets

FUEL INJECTOR

FIELD OF THE INVENTION

The present invention relates to a fuel injector.

BACKGROUND INFORMATION

A fuel injector is discussed in German Published Patent Application No. 198 15 789, characterized by featuring a swirl disk downstream from a valve seat, such disk being made of at least one metallic material, having at least two swirl channels terminating in a swirl chamber and all layers of such disk being built up directly one upon the other by electrodeposition (multi-layer galvanizing), such that they are bonded. The swirl disk is incorporated in the injector in such a way that its surface normal runs obliquely to the longitudinal axis of the injector, at an angle which deviates from 0°, with the result that the orientation of the swirl disk can be used to bring about a stream angle of $\gamma$ relative to the longitudinal axis of the injector.

Disadvantages of the fuel injector of German Published Patent Application No. 198 15 789 may be that a high level of manufacturing effort may be needed, and the resultant costs, which are the consequence of combining a large number of individual components, which it is not possible to integrate into mass-produced fuel injectors without considerable expenditure. In order to modify the fuel injector for any desired potential application, extensive manufacturing and assembly work may be needed. In particular, the jet angles $\alpha$ and $\gamma$ may not be implementable, or may be implemented only unsatisfactorily, using available swirl creation methods. This may cause the jet of fuel or the metered quantity of fuel to be asymmetrical and inhomogeneous.

SUMMARY OF THE INVENTION

The exemplary fuel injector according to the present invention is believed to have the advantage that it is possible to produce the swirl module made of a plurality of tubular hollow bodies at low cost by extrusion, to very small dimensions and to install it simply and inexpensively. Owing to its small size, the swirl module for fuel injectors may be mass producible in a simple manner.

The hollow bodies may be arranged in the swirl module in a twisted or warped form, since this form may be easy or easier to manufacture.

A further advantage may be that the swirl module is situated downstream of the seat, which permits simple installation.

The creation of a swirl chamber may be advantageous, since this causes the turbulent flow created by the hollow bodies to become homogeneous and symmetrical, which in turn makes the mixture cloud stoichiometric.

The cluster of hollow bodies may also be advantageously formed as a cylindrical solid body into which the fuel ducts are incorporated by means of extrusion.

It may be particularly advantageous that the swirl chamber tapers in the direction of ejection of the fuel, this taper being created, for example, by swaging and ensuring on the one hand that the fuel stream pattern is made even more homogeneous and on the other that the swirl module can be securely lodged in the recess of the valve-seat body without complex attaching means.

DETAILED DESCRIPTION

Figure 1:
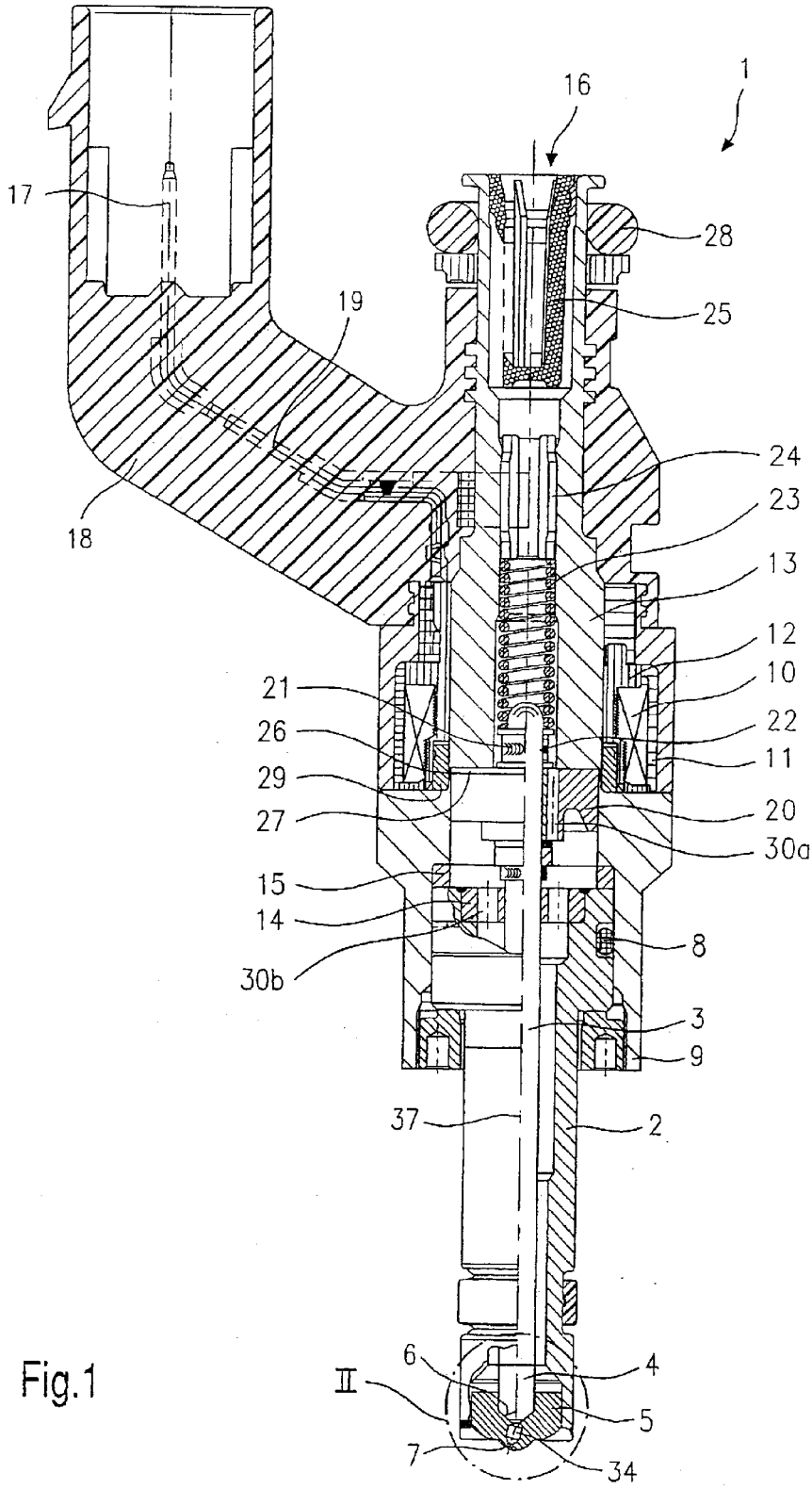
FIG. 1 shows a schematic cross-section through a first exemplary embodiment of a fuel injector according to the present invention.

A fuel injector 1 shown in FIG. 1 is for fuel injection systems of internal combustion engines in which a spark ignites a compressed mixture. Fuel injector 1 is particularly suitable for direct injection of fuel into the combustion chamber, not shown here, of an internal combustion engine.

Fuel injector 1 has a nozzle body 2 in which a valve needle 3 is situated. Valve needle 3 is mechanically connected to a valve-closure member 4 which cooperates with a valve-seat surface 6 situated on a valve-seat body 5 to constitute a sealing seat. Valve-seat member 5 may be inserted in a recess 50 of nozzle body 2. Fuel injector 1 in the exemplary embodiment is an inward-opening fuel injector 1 having an ejection orifice 7. Nozzle body 2 is isolated by a gasket 8 from stationary pole 9 of a solenoid coil 10. Solenoid coil 10 is encapsulated in a coil housing 11 and wound on a bobbin 12, which is in contact with an internal pole 13 of the solenoid coil 10. Internal pole 13 and stationary pole 9 are separated from one another by a clearance 26 and are supported on a connecting component 29. Solenoid coil 10 is excited, through a wire 19, by an electrical current which may be supplied through an electrical plug contact 17. Plug contact 17 is surrounded by a plastic sheathing 18, which may be extruded onto internal pole 13.

Valve needle 3 is guided in a valve needle guide 14, which is disk-shaped. The lift is adjusted by means of a matching adjusting disk 15. On the other side of adjusting disk 15 is an armature 20. This is rigidly connected, by way of a first flange 21, to valve needle 3 which is connected to first flange 21 by means of a welded joint 22. A restoring spring 23 is supported on first flange 21 and in the fuel injector 1 is pre-tensioned by a sleeve 24.

A second flange 31, which is connected to valve needle 3 by way of a welded joint 33, acts as the lower armature stop. A flexible spacer ring 32, which is situated on second flange 31, prevents rebound when fuel injector 1 closes.

Fuel ducts 30*a* and 30*b* run in valve needle guide 14 and in armature 20 and deliver to the fuel ejection orifice 7 the fuel which is supplied from a central fuel supply 16 and filtered through a filter element 25. Fuel injector 1 is isolated by a gasket 28 from a fuel line.

An extruded swirl module 34 is situated on the discharge side of the sealing seat, in the present exemplary embodiment being inserted in a recess 35 on the discharge side of the valve-seat member 5. A detailed representation of swirl module 34 is shown in FIGS. 2 and 3B.

When fuel injector 1 is in its idle state, armature 20 is pushed by restoring spring 23 against the lift direction in such a way that valve-closure member 4 is held against valve seat 6 so as to form a seal. When solenoid coil 10 is excited, it creates a magnetic field which moves armature 20 against the spring force of restoring spring 23 in the lift direction, the lift being defined by an operational clearance 27 which is present between internal pole 12 and armature 20 in the idle state. Armature 20 also moves flange 21, which is welded to valve needle 3, in the lift direction. Valve-closure member 4 which is rigidly connected to valve needle 3 lifts from valve-seat surface 6 and the fuel being fed to ejection orifice 7 through fuel ducts 30*a* and 30*b*, and also through fuel ducts 45 formed in swirl module 34, is ejected. Ejection orifice 7 is advantageously sloped relative to a longitudinal axis 37 of the fuel injector 1 by an ejection angle γ.

If the current to the coil is switched off, once the magnetic field has sufficiently decayed, armature 20 falls away from internal pole 13 under the pressure of the restoring spring 23, whereby flange 21, which is rigidly connected to valve needle 3, moves against the lift direction. Valve needle 3 as a result is moved in the same direction, whereby valve-closure member 4 seats onto valve-seat surface 6 and fuel injector 1 is closed.

Figure 2:
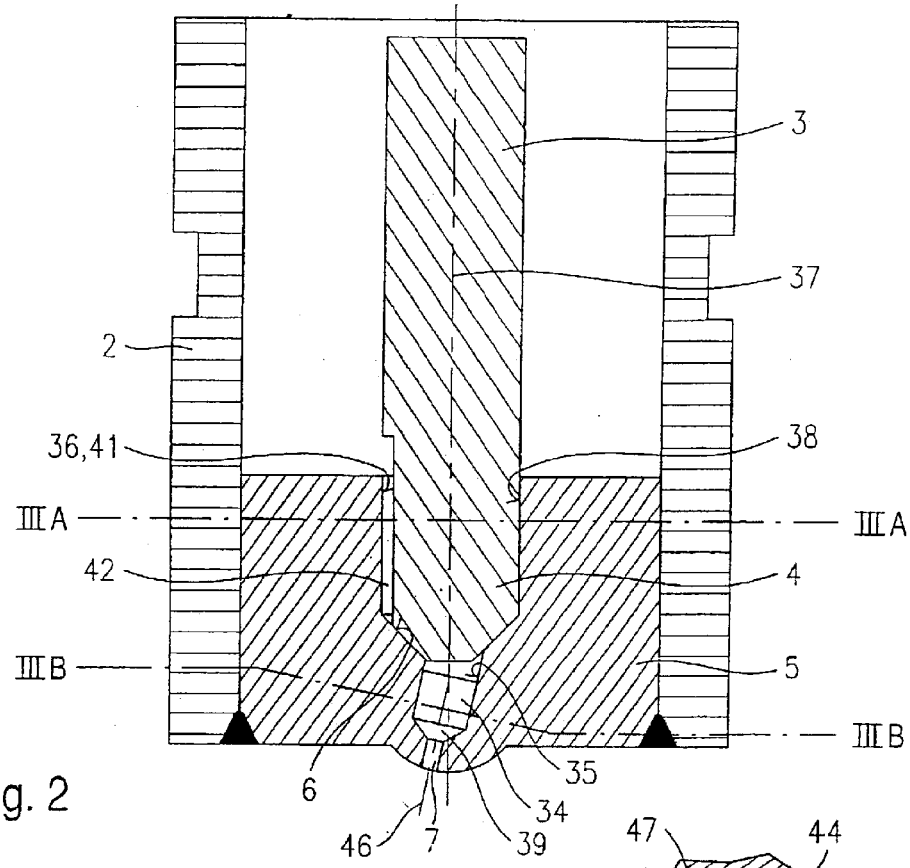
FIG. 2 shows a schematic cross-section of the exemplary embodiment shown in FIG. 1 of the fuel injector according to the present invention, in the area marked as II in FIG. 1.

FIG. 2 shows in a partial cross-sectional representation the ejection end of the first exemplary embodiment shown in FIG. 1 of the fuel injector 1. The enlarged area is marked as II in FIG. 1. Identical components are marked with matching references.

The portion represented in FIG. 2 shows the valve-seat member 5 which features the valve-seat surface 6 that cooperates with valve-closure member 4 to constitute the sealing seat and also carries out a supporting and guiding function with respect to valve needle 3 or valve-closure member 4. In the present exemplary embodiment, this is in the form of a valve needle guide 38. In consequence, eccentricities or tilting of valve needle 3 and valve-closure member 4 are prevented and consequently malfunctions of fuel injector 1 are avoided. Valve needle guide 38 is shown in greater detail in FIG. 3A.

Swirl module 34 is located on the ejection side of the sealing seat. It may, for example, be pressed into the recess 35 on the downstream side of valve-seat member 5. In order to secure swirl module 34 against slipping out of position, ejection orifice 7, which is located on the downstream side of swirl module 34 and which at the same time acts as a swirl chamber 39 in its area immediately adjacent to swirl module 34, can be swaged, for example by a stamping tool not shown here, so that swirl chamber 39 tapers in the direction of discharge. At the same time, by swirl chamber 39, the turbulent flow generated in the swirl module 34 is made homogeneous, which assists in achieving an even cloud of mixture for injection into the combustion chamber of the internal combustion engine.

Figure 3A:
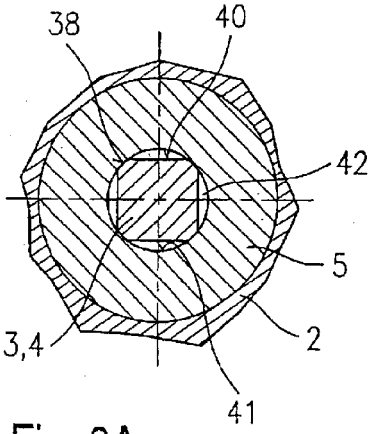
FIG. 3A shows a schematic cross-section through the swirl module shown in more detail in FIG. 2, along the line IIIA—IIIA in FIG. 2.
Figure 3B:
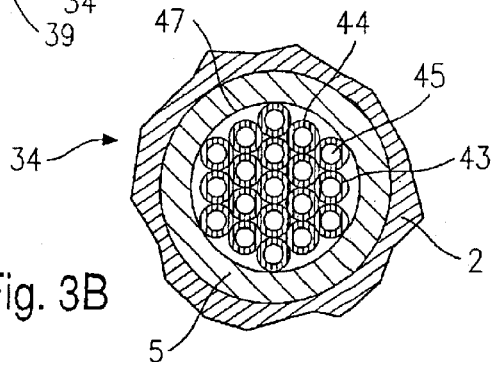
FIG. 3B shows a schematic cross-section through the swirl module shown in more detail in FIG. 2, along the line IIIB—IIIB in FIG. 2.

FIG. 3A shows in an axial cross-section along the line IIIA—IIIA in FIG. 2 valve-seat member 5 in the area of valve needle guide 38. In order to be able to supply the in-flowing fuel to the sealing seat, valve needle 3 or valve-closure member 4 has at least one polished section (the exemplary embodiment may have four such polished sections, which may be better or more desirable) forming, together with an inner wall 41 of a recess 36 in the inward side of valve-seat member 5, fuel ducts 42 which direct the fuel towards the sealing seat.

Between fuel ducts 42 valve needle 3 or valve-closure member 4 is in contact with the inner wall 41 of the recess 36 on the inward side of valve-seat member 5, thus ensuring the function of valve needle guide 38.

FIG. 3B shows in a cross-sectional representation along line IIIB—IIIB in FIG. 2 a cross-section through swirl module 34 of fuel injector 1.

Here, swirl module 34 has a plurality of tubular hollow bodies 43 which are grouped together into a cluster 44. The first exemplary embodiment described here incorporates separately manufactured hollow bodies 43. Hollow bodies 43 have fuel ducts 45, which may be arranged centrally, which direct the fuel flowing from the sealing seat to ejection orifice 7 into swirl chamber 39. Hollow bodies 43 are shown in FIG. 3B with exaggerated diameters, and completely fill the cylindrical envelope 47 of cluster 44.

Hollow bodies 43 may be advantageously created by extrusion. In this process a material is rendered plastic and subsequently shaped by being pressed out of an extruder. By using the process several times over and applying subsequent finishing work, a body can be created with any desired outside shape and holes of a diameter that can be 100 μm or less. The ratio of the length of the extruded body to the diameter of the holes can be up to 2000:1.

Hollow bodies 43 of the desired shape and number are grouped together into a cluster 44. In order for a swirl to be imparted to the fuel flowing through cluster 44, cluster 44 is twisted or warped into a cord-like structure, with hollow bodies 43 following a helical path in the axial plane. Thereby, the fuel flowing through them is also brought into a spiral path so that the fuel entering swirl chamber 39 thus generates a homogeneous turbulent flow which in turn ensures a homogeneous mixture cloud at the moment of injection into the combustion chamber.

Since when cluster 44 is twisted or warped, hollow bodies 43 that are further out along the radius are twisted more than those that are further in, a resultant lack of homogeneity in the injected jet can be avoided for example by partially covering up hollow bodies 43 which are further in along the radius.

Figure 3C:
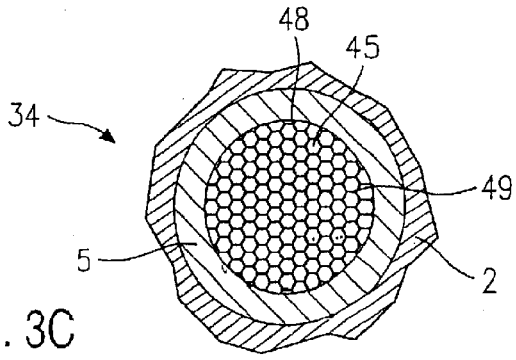
FIG. 3C shows a schematic cross-section through a second exemplary embodiment of a swirl module along line IIIB—IIIB in FIG. 2.

FIG. 3C shows in the same view as FIG. 3B a second exemplary embodiment of fuel injector 1.

Here, extruded swirl module 34 is not composed of individual hollow bodies 43 but is formed of a cylindrical body 48, which may be of metal. This is then provided in turn with fuel ducts 45 by means of extrusion, so that in the exemplary embodiment a honeycomb structure 49 is created. Instead of a honeycomb structure, a structure with round or differently shaped fuel ducts 45 may similarly be imagined.

Cylindrical body 48 may then also be re-shaped by twisting so that fuel ducts 45, originally extruded in straight form, are twisted into a helix. As in the case of the first exemplary embodiment described above, fuel ducts 45 that are further in along the radius are then virtually parallel to longitudinal axis 46 of the swirl module and make little or no contribution to creating turbulence, whereas fuel ducts 45 that are further out along the radius make the greatest contribution to the turbulence. A non-swirling parallel flow can also be countered, for example, by covering up fuel ducts 45 which are further in along the radius.

The present invention is not restricted to the exemplary embodiments shown and, for example, can also be applied with extruded swirl modules 34 having a greater or lesser number of fuel ducts 45 or with extruded swirl modules 34 arranged on the inward side of the sealing seat, as well as with any desired models of fuel injector 1.

What is claimed is:

1. A fuel injector, for direct injection of fuel into a combustion chamber of an internal combustion engine, the fuel injector comprising:

a valve-closure member;

an ejection orifice;

a swirl module; and a valve-seat surface formed on a valve-seat body, the valve-closure member together with the valve-seat surface constituting a sealing seat;

wherein the swirl module includes a plurality of tubular hollow bodies arranged in a cluster to impart a swirl to the fuel flowing towards the ejection orifice through fuel ducts formed in the tubular hollow bodies; and wherein the cluster is arranged parallel to a longitudinal axis of the swirl module and is twisted around the longitudinal axis.

2. The fuel injector of claim 1, wherein the tubular hollow bodies are produced by extrusion.

3. The fuel injector of claim 1, wherein the swirl module is situated downstream from the sealing seat.

4. The fuel injector of claim 3, wherein the swirl module is situated in a recess on the downstream side of the valve-seat body.

5. The fuel injector of claim 4, wherein a swirl chamber is formed downstream from the swirl module.

6. The fuel injector of claim 5, wherein the fuel ducts of the cluster of the tubular hollow bodies terminate in the swirl chamber.

7. The fuel injector of claim 1, wherein the swirl module is formed as a cylindrical body into which a plurality of the fuel ducts are incorporated by extrusion.

8. A fuel injector, for direct injection of fuel into a combustion chamber of an internal combustion engine, the fuel injector comprising:

a valve-closure member;

an ejection orifice;

a swirl module; and a valve-seat surface formed on a valve-seat body, the valve-closure member together with the valve-seat surface constituting a sealing seat;

wherein the swirl module includes a plurality of tubular hollow bodies arranged in a cluster to impart a swirl to the fuel flowing towards the ejection orifice through fuel ducts formed in the tubular hollow bodies; and wherein an envelope of the cluster is cylindrical in form.

9. A fuel injector, for direct injection of fuel into a combustion chamber of an internal combustion engine, the fuel injector comprising:

a valve-closure member;

an ejection orifice;

a swirl module; and a valve-seat surface formed on a valve-seat body, the valve-closure member together with the valve-seat surface constituting a sealing seat;

wherein the swirl module includes a plurality of tubular hollow bodies arranged in a cluster to impart a swirl to the fuel flowing towards the ejection orifice through fuel ducts formed in the tubular hollow bodies;

wherein the swirl module is situated downstream from the sealing seat; wherein the swirl module is situated in a recess on the downstream side of the valve-seat body;

wherein a swirl chamber is formed downstream from the swirl module;

wherein the fuel ducts of the cluster of the tubular hollow bodies terminate in the swirl chamber; and wherein a diameter of the swirl chamber decreases in a downstream direction.

10. The fuel injector of claim 9, wherein the diameter of the swirl chamber is reduced by swaging against a direction of discharge.

11. The fuel injector of claim 10, wherein the swirl module is retained in the valve-seat body by swaging the swirl chamber.

12. A fuel injector, for direct injection of fuel into a combustion chamber of an internal combustion engine, the fuel injector comprising:

a valve-closure member;

an ejection orifice;

a swirl module; and a valve-seat surface formed on a valve-seat body, the valve-closure member together with the valve-seat surface constituting a sealing seat;

wherein the swirl module includes a plurality of tubular hollow bodies arranged in a cluster to impart a swirl to the fuel flowing towards the ejection orifice through fuel ducts formed in the tubular hollow bodies;

wherein the swirl module is formed as a cylindrical body into which a plurality of the fuel ducts are incorporated by extrusion; and wherein the cylindrical body is twisted so that the fuel ducts impart turbulence to the fuel flowing through them.

* * * * *